United States Patent [19]

Muguruma et al.

[11] Patent Number: 4,834,148

[45] Date of Patent: May 30, 1989

[54] REINFORCEMENT BINDING MACHINE

[75] Inventors: Hiroshi Muguruma, Kyoto; Hiroshi Toyoda; Takayasu Sawano, both of Shizuoka, all of Japan

[73] Assignee: Kabushiki Kaisha Toyoda Kihan, Shizuoka, Japan

[21] Appl. No.: 46,321

[22] Filed: May 5, 1987

[30] Foreign Application Priority Data

May 17, 1986 [JP] Japan ..... 61-111792

[51] Int. Cl.[4] ..... B21F 9/02

[52] U.S. Cl. ..... 140/119; 140/57; 140/93 A

[58] Field of Search ..... 140/57, 93 A, 93.6, 140/119

[56] References Cited

U.S. PATENT DOCUMENTS 3,391,715 7/1968 Thompson ..... 140/93.6

4,362,192 12/1982 Furlong et al. ..... 140/93.6

4,508,030 4/1985 Grenon ..... 140/119

*Primary Examiner*—Lowell A. Larson

*Attorney, Agent, or Firm*—Schwartz & Weinrieb

[57] ABSTRACT

A reinforcement binding machine using a steel wire comprises a means for feeding the steel wire into a binding station for binding reinforcements together, a guide means provided with a guide path for guiding the steel wire fed into the binding station along a curve encircling the reinforcements and defining the binding station, a means for twisting the steel wire looped by the guide path and defining a slot through which the steel wire fed into the binding station is capable of passing, and a means for rotating the twisting means about the axis crossing the axis of the loop formed from the steel wire so as to twist the steel wire, the twisting means being provided with a pair of pins opposed to each other through the slot and adapted to be moved relatively in the axial direction with respect to the loop, and a means for normally biasing at least one of the pins toward the other one of the pins such that the end faces of the pins are abutted against each other within the binding station.

20 Claims, 11 Drawing Sheets

REINFORCEMENT BINDING MACHINE

BACKGROUND OF THE INVENTION

1. Field of the Invention

This invention relates to a reinforcement binding machine for binding a plurality of reinforcement members that cross each other, that is, longitudinally and laterally oriented reinforcements defining a reinforcement cage, by means of a steel wire.

2. Description of the Prior Art

One type of machine for binding a plurality of reinforcement members that cross each other by means of a steel wire disposed at the intersections of these reinforcements has been disclosed in Japanese Patent Public Disclosure (KOKAI) No. 51265/80. According to this prior art reinforcement binding machine, the steel wire is guided by means of a guide defining a binding station, so as to be wound a number of times around the reinforcements so as to form a loop encircling the reinforcements. Through the loop are inserted a pair of pins from the axially opposed sides of the loop along the axis thereof. The pins are supported by means of a rotor which is rotated about an axis orthogonal to the axis of the pin and extending diametrically with respect to the loop. Thus, the steel wire wound through means of the plurality of turns is twisted by the pins. The respective pins are normally spaced from each other by means of spring force and butted against each other at the time of binding so as to engage the steel wire to be twisted by means of centrifugal force due to the rotation of the rotor exceeding the spring force.

However, the prior art reinforcement binding machine has such a construction that both pins are butted against each other by means of the centrifugal force overcoming the spring force. Therefore, both pins are left spaced from each other even if the rotor is rotated as a result of the centrifugal force not exceeding the spring force as a result of an insufficient rotational speed of the rotor. Under such a condition, the pins are not inserted into the loop so that the steel wire cannot be properly twisted.

Furthermore, in the prior art reinforcement binding machine, when the rotational speed of the rotor is reduced due to the beginning of the twisting of the steel wire, the centrifugal force becomes smaller than the spring force. As a result, even if the pins are inserted into the loop, since the pins are separated from each other by means of the spring force so as to be disengaged from the steel wire, the reinforcements cannot be sufficiently bound. When the rotational speed of the rotor and thus of the pins is increased so as to prevent the defective binding, it is difficult to achieve proper timing and completion of the twisting operation, and consequently, excessive or insufficient twisting is produced since the prior art machine is constructed so as to complete the twisting operation when the centrifugal force becomes smaller than the spring force. In particular, if the steel wire is excessively twisted, it is twisted off or the pins are strongly restrained by means the steel wire even if the steel wire is not twisted off. Therefore, the pins cannot be disengaged from the twisted steel wire by means of the spring force.

Furthermore, in the prior art reinforcement binding machine, since the timing of the butting operation, that is, the closing of the pins against each other and the timing of the disengaging operation, that is, the opening of the pins with respect to each other, depend upon the rotational speed and rotational timing of the rotor, the steel wire cannot be twisted to a predetermined strength.

Also, since the prior art reinforcement binding machine is constructed so as to determine the relative positional relationship between the reinforcements and the reinforcement binding machine according to the experience of an operator, the position of the reinforcements in the binding portion defined by means of the guide for guiding the steel wire in the form of a loop along a curve encircling the reinforcements becomes indefinite. In this case, as the twisting means is rotated at the time of binding, the guide comes into contact with the reinforcements. As a result, the binding operation becomes troublesome.

Furthermore, since the prior art reinforcement binding machine is provided with a cutter for cutting off the steel wire separately from the steel wire twisting means, a cutter driving mechanism and a means for synchronizing the cutter with the steel wire twisting means or the like are needed in addition to the cutter.

Still further, in the prior art reinforcement binding machine, since the twisting means is freely rotatable at the time it is desired to stop its rotation, a steel wire inlet of the twisting means has to be manually aligned with a steel wire outlet of a steel wire feeding path at the time of beginning the binding operation. Furthermore the position of the steel wire inlet of the twisting means has to be manually maintained so as to be aligned with the steel wire outlet of the steel wire feeding path at the time of feeding the steel wire.

Yet further, in the prior art reinforcement binding machine, since a guide path provided within the guide is a groove which opens to the inside of the guide throughout the total length of the guide, the leading end of the steel wire moves along the guide path contacting the depth surface of the guide path as the steel wire is fed while a rear portion escapes from the guide path inwardly of the guide and thus the steel wire cannot be transformed into a loop encircling the reinforcements as a result of the steel wire having a predetermined degree of rigidity.

OBJECTS OF THE INVENTION

An object of the present invention is to provide a reinforcement binding machine capable of twisting a steel wire accurately.

Another object of the present invention is to provide a reinforcement binding machine capable of twisting the steel wire to a predetermined degree.

A further object of the present invention is to provide a reinforcement binding machine in which it is not necessary to specifically provide a cutter driving mechanism for cutting off the steel wire and a means for synchronizing the cutter with a twisting means or the like.

A still further object cf the present invention is to provide a reinforcement binding machine in which it is not necessary to manually align a steel wire inlet of the twisting means with a steel wire outlet of a steel wire feeding path at the time of beginning of the binding operation.

A yet further object of the present invention is to provide a reinforcement binding machine capable of accurately transforming the steel wire fed into a guide means into a loop shape along a guide path of the guide means.

SUMMARY OF THE INVENTION

The reinforcement binding machine according to the present invention comprises a means for feeding a steel wire into a binding portion for binding reinforcement members together, a guide means provided with a guide path for guiding the steel wire fed into the binding portion along a curve encircling the reinforcements so as to define the binding portion, a means for twisting the steel wire looped by means of the guide path and defining a slot through which the steel wire fed into the binding station is capable of passing and a means for rotating the twisting means about the axis crossing the axis of the loop formed from the steel wire so as to twist the steel wire, the twisting means being provided with a pair of pins opposed to each other through the slot and disposed relatively movable in the axial direction of the loop, and a means for normally biasing at least one of the pins such that respective end faces of the pins butt against each other within the binding portion.

In the reinforcement binding machine according to the present invention, respective end faces of a pair of pins are normally butted against each other by the biasing means and the steel wire is guided by the guide means so as to surround the butted pins and reinforcements to be bound. Therefore, according to the present invention, the steel wire can be securely twisted when the rotation of the twisting means is started.

In a preferred embodiment according to the present invention, the end of at least one pin butted against the other pin is shaped so as to produce a force for separating both pins from each other after twisting of the steel wire. According to this embodiment, when the steel wire is twisted by a predetermined amount, both pins are automatically and relatively moved so as to be separated from each other against the biasing force of the biasing means. Therefore, the pins are disengaged from the steel wire so as to complete the twisting of the steel wire. Thus, the steel wire is securely twisted to a predetermined degree.

Furthermore, in the preferred embodiment according to the present invention, a feeding means, a guide means, a twisting means, and a rotary means are supported within a main body having a handle portion, and the reinforcement binding machine can be manually carried and operated. Still further, it can be used either in a factory or at a remote work site.

Yet further, in the preferred embodiment according to the present invention, a portion of the twisting means for defining a steel wire receiving spot within the slot closely contacts the steel wire outlet of a member for defining the steel wire feeding path so as to serve as a cutter portion for cutting off the steel wire in cooperation with the steel outlet at the time of rotating the twisting means. Thus, according to this embodiment, the steel wire is cut off at the beginning of the rotation of the twisting means by the cooperative action of the twisting means and the member for defining the steel wire feeding path.

According to the preferred embodiment of the present invention, the twisting means is angularly rotated by the aligning means in a non-rotational mode so that the slot is automatically aligned with the steel wire outlet of the steel wire feeding path in order to receive the steel wire within the slot.

According to the preferred embodiment of the present invention, the twisting means is also automatically maintained at a predetermined orientation, in which the slot is aligned with the steel wire outlet of the steel wire feeding path, by an orientation maintaining means during feeding of the steel wire.

Furthermore, according to the preferred embodiment of the present invention, the steel wire fed into a first guide of the guide means for feeding the steel wire has one end moved along a guide path of the first guide and the other portions thereof are prevented from escaping from the guide path in the proximity of the steel wire inlet of the first guide by means of a second guide of the guide means. As a result, the steel wire fed into the first guide is fed while being prevented from being separated from the guide path by the second guide in order to be effectively transformed into a curved shape along the guide path by the cooperative action of the first and second guides.

BRIEF DESCRIPTION OF THE DRAWINGS

The other objects and features of the invention will become apparent from the following description of preferred embodiments of the invention with reference to the accompanying drawings, in which.

DETAILED DESCRIPTION OF THE PREFERRED EMBODIMENTS

Figure 1:
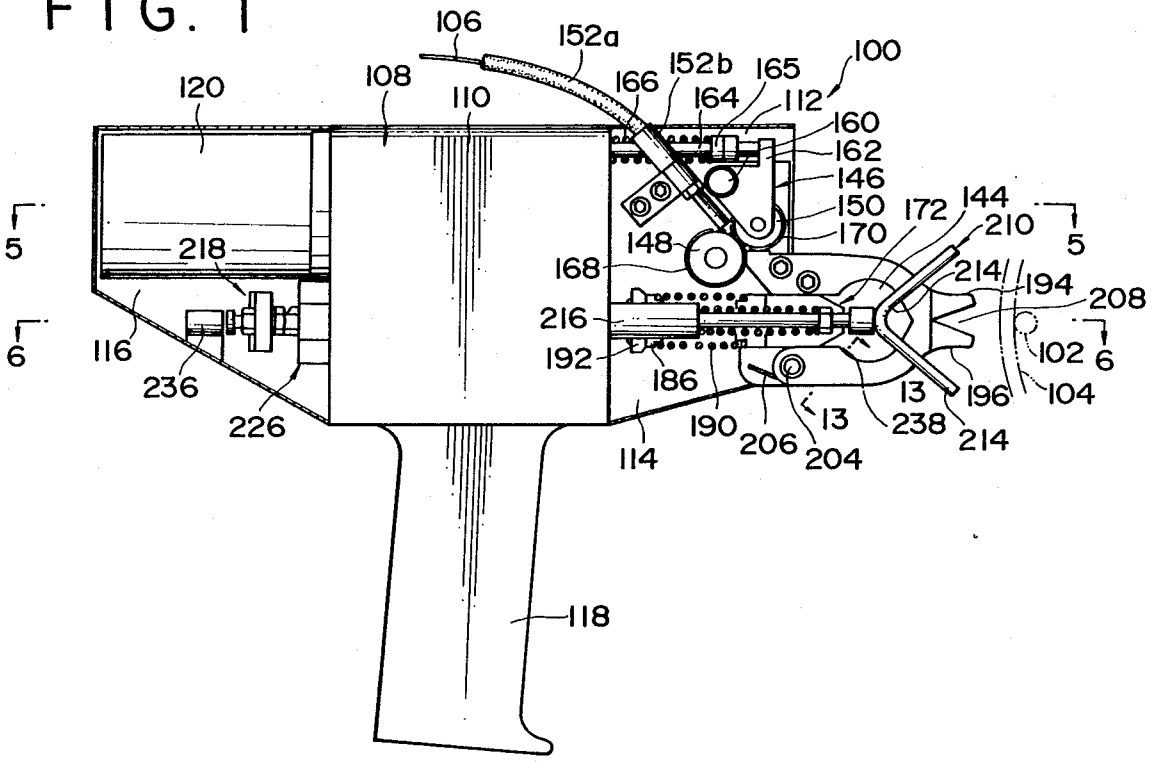
FIG. 1 is a front view showing an embodiment of a reinforcement binding machine according to the present invention.
Figure 2:
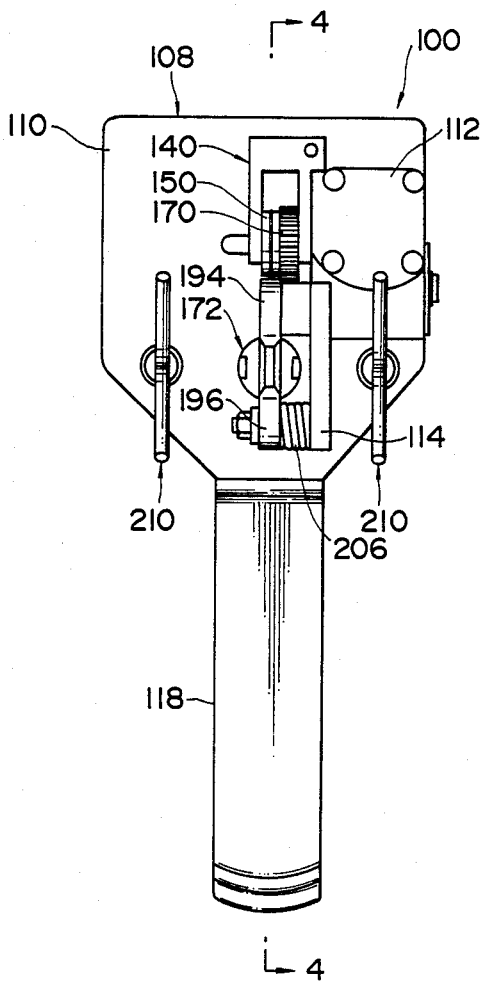
FIG. 2 is a right side view showing the reinforcement binding machine shown in FIG. 1.

A reinforcement binding machine 100 shown in FIGS. 1 and 2 comprises a main body 108 for supporting various mechanisms for binding the intersection of reinforcement members 102, 104 with an elongated steel wire 106. In the embodiment shown, the reinforcement 102 is one of a plurality of longitudinal reinforcements for a concrete pile and the reinforcement 104 is a spiral reinforcement wound around the longitudinal reinforcements. The reinforcements 102, 104 however may be other reinforcements, such as, for example, reinforcements for another type of reinforced concrete structure, for example.

As shown in FIGS. 1 to 6, the main body 108 is provided with a gear case 112 projecting forwardly from a box-like frame 110, a support wall 114 provided integrally with the gear case 112, a cover 116 removably disposed behind the frame 110 and a handle portion 118 extending downwardly from the frame 110. Since the reinforcement binding machine 100 is provided with the handle portion 118, the machine 100 can be carried and manually operated. Furthermore, it can be used either in the factory or at a remote work site or at any other desired locations.

Figure 3:
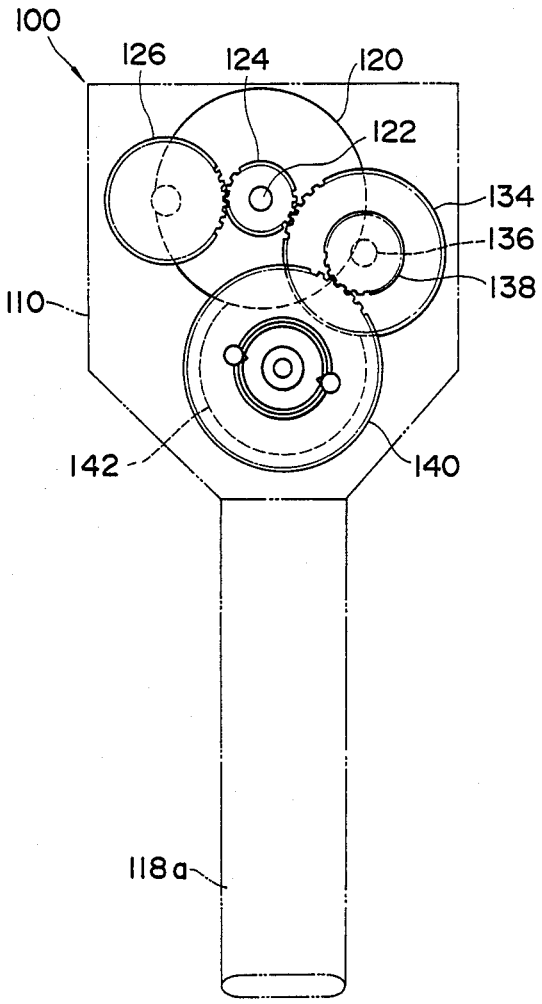
FIG. 3 is an explanatory illustration showing the engaging condition of the gears.
Figure 4:
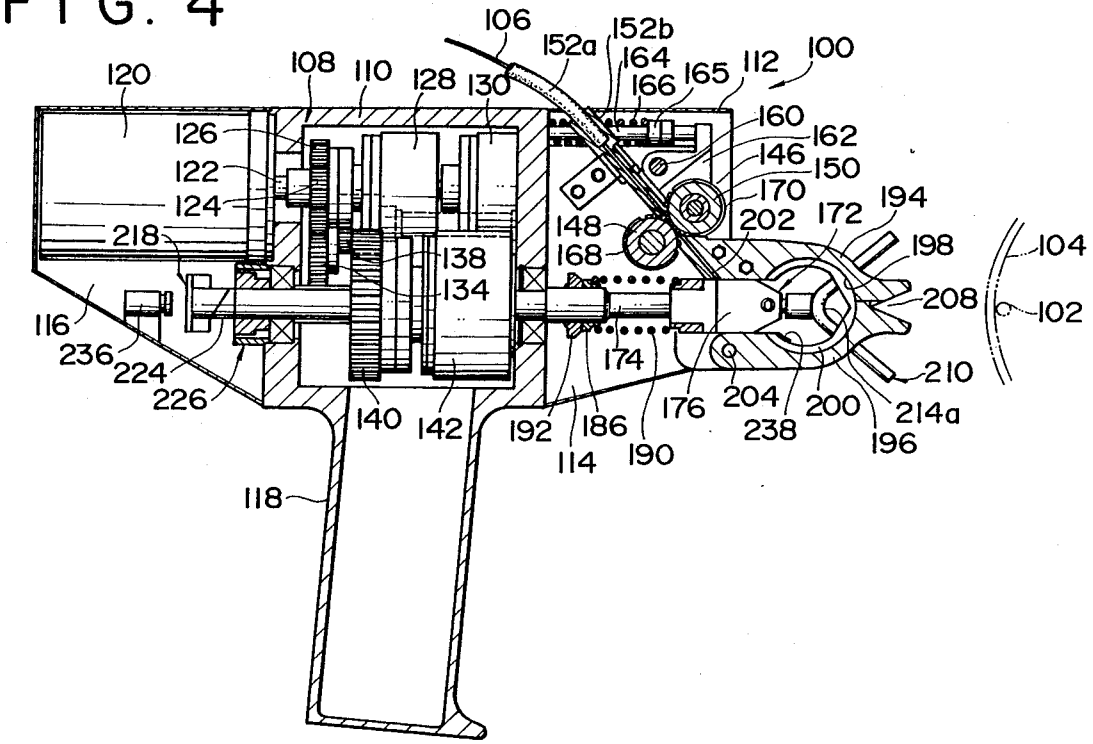
FIG. 4 is a sectional view taken along the line 4—4 in FIG. 2.
Figure 5:
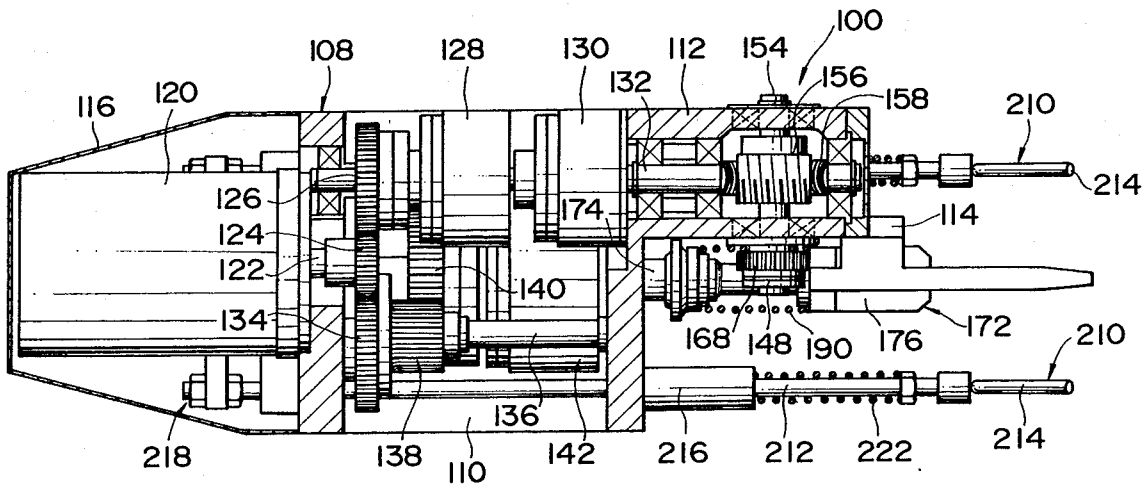
FIG. 5 is a sectional view taken along the line 5—5 in FIG. 1.

On the rear side of the frame 110 there is mounted a rotary source 120 such as an electric motor, an air motor, or the like. The power, that is, the turning force of the rotary source 120, as shown in FIGS. 3 to 5, is transmitted to a shaft 132 through means of an output shaft 122 extending through a rear wall of the frame 110, a gear 124 provided upon the output shaft 122, a clutch 128 having a gear 126 meshing with the gear 124 and disposed within the frame 110, and a brake 130 connected to the output shaft of the clutch 128 and also disposed within the frame 110. The shaft 132 extends axially within the gear case 112 and is rotatably supported by means of the gear case 112.

The turning force of the rotary source 120, as shown within FIGS. 3 to 5, is also transmitted from the gear 124 to a clutch 142 having a gear 140 through means of a gear 134 meshing with the gear 124, a shaft 136 connected to the gear 134, and a gear 138 provided upon the shaft 136 and meshed with the gear 140.

Within the gear case 112 there is supported a steel wire feeding mechanism 146 for feeding the wire 106 to a binding station 144. The steel wire feeding mechanism 146 is provided with a pair of steel wire feeding rollers 148, 150 disposed externally of the gear case 112. The steel wire 106 is guided to the rollers 148, 150 by means of a protective guide **152*a* and a tubular guide 152*b* coupled with an end of the protective guide 152*a* and fixed to the gear case 112**.

As shown in FIG. 5, one roller 148 is fixed to a shaft 154 extending horizontally and rotatably through the gear case 112. The turning force transmitted to the shaft 132 is transmitted to the roller 148 through a worm 158 mounted upon the shaft 132, a worm wheel 156 meshing with the worm 158, and the shaft 154 mounting the worm 158.

The other roller 150, as shown in FIGS. 1 to 4, is rotatably supported by means of a lever 162 pivotably connected to the gear case 112 by means of a pin 160 and normally biased toward the roller 148 by means of a spring 166 surrounding a slide shaft 164 slidably supported in a back and forth mode upon the gear case 112. The force for biasing the roller 150 against the roller 148 can be varied by adjusting the position of a nut 165 threadedly engaged upon the slide shaft 164.

The rollers 148, 150 have synchronizing gears 168, 170 meshing with each other. As a result, both rollers 148, 150 are rotated in synchronization with each other so as to feed the steel wire 106 which is supplied to the guide **152*b* into the binding station 144**.

Figure 6:
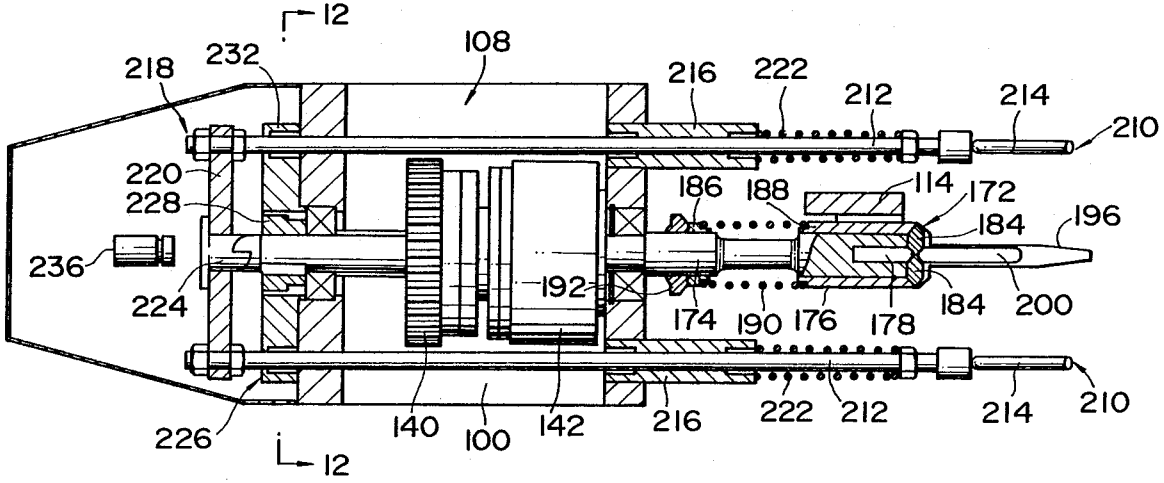
FIG. 6 is a sectional view taken along the line 6—6 in FIG. 1.
Figure 7:
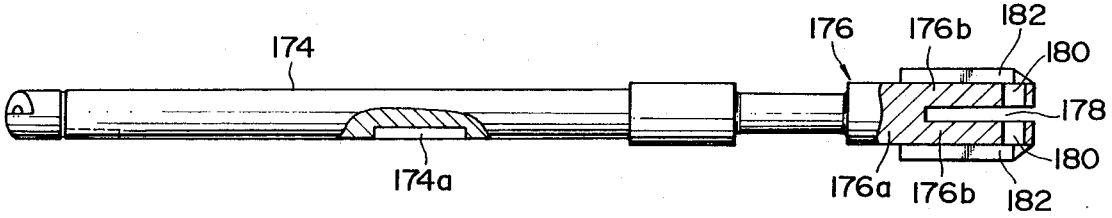
FIG. 7 is a front view, partially broken away, showing a rotary shaft.

Also, as shown in FIGS. 4 to 6, the reinforcement binding machine 100 comprises a twisting mechanism 172 for twisting the steel wire 106 fed into the binding station 144. The twisting mechanism 172 is provided with a rotary shaft 174 rotatably disposed coaxially with the clutch 142 and the frame 110. The rotary shaft 174 is coupled with the clutch 142 by means of a key (not shown) and is rotated about its axis by receiving the turning force of the rotary source 120 through means of the clutch 142. As shown in FIG. 7, the rotary shaft 174 has a groove **174*a* for receiving the key for coupling the rotary shaft 174 with the clutch 142**.

Figure 8:
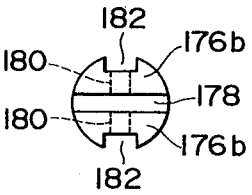
FIG. 8 is a right side view showing the head in FIG. 7.

The rotary shaft 174 is provided with a bifurcated head 176 at the end thereof which is disposed toward the binding station 144. As shown in FIG. 7, the head 176 has a base **176*a* fixedly provided upon the end of the rotary shaft 174 and a pair of branches 176*b* extending from the base 176*a* parallel to the axis of the rotary shaft 174, the base 176*a* and branches 176*b* defining a slot 178. As shown in FIGS. 7 and 8, the base 176*a* and branches 176*b* are of circular cross-section having the same diametrical dimensions. Portions of the branches 176*b* opposed to each other across the slot 178 are formed with holes 180 extending from the slot 178 through an outer peripheral portion thereof. Each branch 176*b* is formed upon the outer peripheral surface thereof with a groove 182 extending axially of the rotary shaft 174 past the holes 180**.

Figure 9:
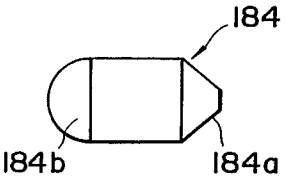
FIG. 9 is a front view showing a pin.

In the holes 180 of the branches **176*b* are disposed pins 184 which are movable toward and away from each other. Each of the pins 184 (FIG. 9 shows one of them) has a conical front and 184*a* and a semispherical rear end 184*b*. The front ends 184*a* are disposed so as to be opposed to each other within the holes 180. As will be described later, the front end 184*a* may have other shapes so as to gradually reduce the diametrical dimension toward the front end such as, for example, a U-shape, V-shape, semicircular sectional shape, conical shape, and semispherical shape, so long as the force for separating the pins 184 from the opponent one when twisting the steel wire 106 acts upon the pins 184 through means of the steel wire 106**.

Figure 10:
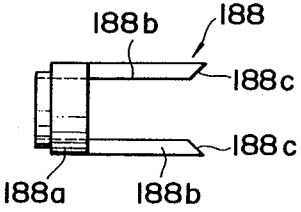
FIG. 10 is a front view; showing a slider.

The respective pins 184 are butted against each other by a biasing means including a receiving seat 186 disposed upon the rotary shaft 174, a slider 188 movably supported upon the shaft 174 in the axial direction of the rotary shaft 174, a compression coil spring 190 interposed between the receiving seat 186 and the slider 188, and a nut 192 threadedly engaged onto the rotary shaft 174. As shown in FIG. 10, the slider 188 is provided with a ring **188*a* slidably disposed upon an end of the rotary shaft 174 and a pair of biasing pieces 188*b* extending parallel to the axis of the ring 188*a* from the ring and slidably received within the groove 182 of each branch 176*b*. The forward end surface of each biasing piece 188*b* has a tapered surface 188*c* by means of which force for butting the pins 184 against each other is applied to the pins 184. The biasing force of the spring 190 can be set to any value by adjusting the position of the nut 192 upon the rotary shaft 174 so as to adjust the interval between the receiving seat 186 and the slider 188**.

Figure 15:
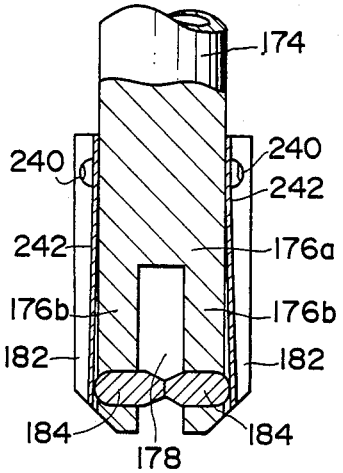
FIG. 15 is a sectional view showing another embodiment of a biasing means for the pin.

As the biasing means for butting the pins 184 against each other, as shown in FIG. 15, for example, other means may be used, such as, for example, a leaf spring 242 disposed within the groove 182 of each branch **176*b* and fixed to the head 176 by means of a screw 240**.

As shown in FIGS. 1 and 4, a pair of guides 194, 196 for defining the binding station 144 are disposed on an end of the support wall 114. The respective guides 194, 196 have arcuate portions opposed to each other. The respective guides 194, 196 are formed upon the arcuate portions with steel wire guide paths 198, 200 for guiding the steel wire 106 fed into the binding station 114 through means of an inner portion having a depth greater than that of each pin 184 disposed within the slot 178 of the twisting mechanism 172 along a curve encircling the reinforcements 102, 104. The steel wire guide paths 198, 200 are grooves which open toward the inside of the arcuate portions, that is, the interior side of the binding station 144.

The guide 194 is fixed to the support wall 114 upon the rear end thereof and is formed upon the rear end edge with a steel wire feeding path 202 for guiding the steel wire 106 fed into the binding station 144 toward an inner portion having a depth greater than that of the pin 184 disposed within the slot 178 of the twisting mechanism 172. The steel wire feeding path 202 in the embodiment shown is a slot extending from the side of the rollers 148, 150 through the binding station 144, although it may also be a groove which extends rearwardly. The end face of the neighborhood of the steel wire outlet from the steel wire feeding path 202 of the guide 194 to the binding station 144 is adapted to have a curved surface with approximately the same curvature as the outer peripheral surface of the head 176 of the twisting mechanism 172.

Figure 14:
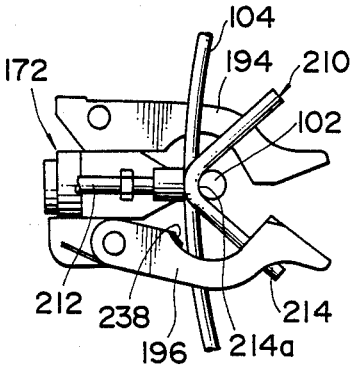
FIG. 14 is a front view showing the opened condition of a guide for defining a binding portion.

The other guide 196, as shown in FIG. 14, is also supported by means of the support wall 114 in such a manner that the guide 196 can be angularly rotated about the pin 204 provided upon one end of the guide 196 whereby the other end of the guide 196 can approach and be separated from the end of the guide 194. The guide 196 is normally biased by means of a spring 206 shown in FIG. 1 in the direction of causing the end to come into contact with an end of the pin 184.

As shown in FIGS. 1 and 2, the opposed end faces of the guides 194, 196 are inclined so as to define a V-shaped space 208 opening forwardly as defined by means of the opposed end surfaces when both ends come into contact with each other.

Figure 11:
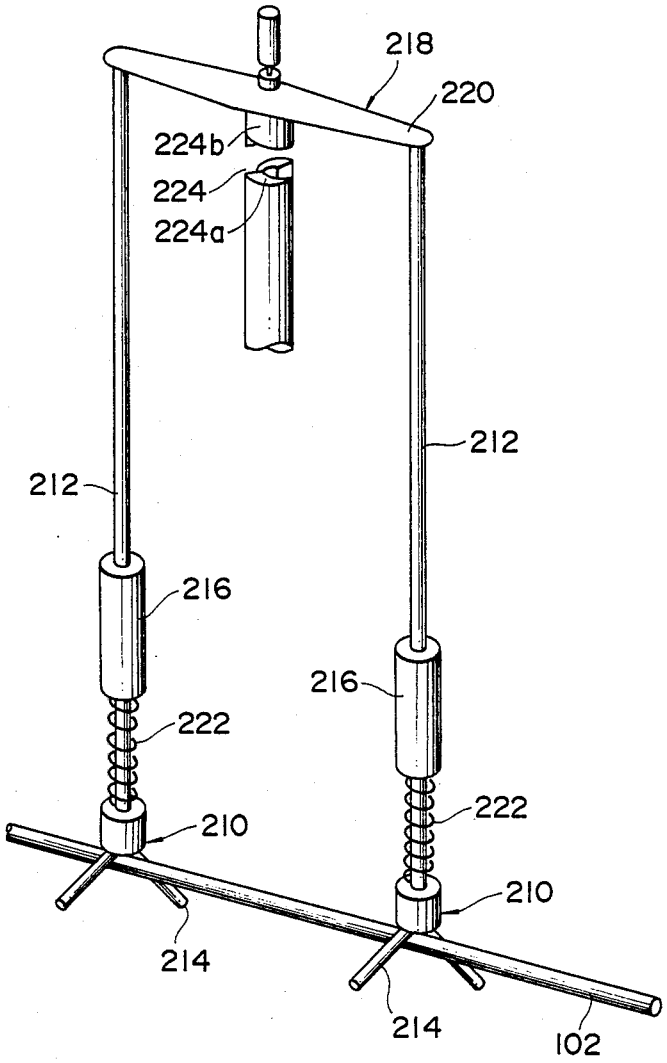
FIG. 11 is a perspective view showing a positioning mechanism and an aligning mechanism.

Furthermore, as shown in FIGS. 1, 6, and 11, the reinforcement binding machine 100 comprises a positioning mechanism 210 for determining the relative positional relationship between the reinforcements 102, 104 and the reinforcement binding machine 100 when performing a binding operation. In the embodiment shown, as shown in FIG. 6, the positioning mechanism 210 is provided with rods 212 disposed symmetrically upon opposite sides of the rotary shaft 174 and Y-shaped positioning members 214 are fixed to the ends of the rods respectively. Each of the rods 212 extends parallel to the rotary shaft 174 and is supported upon frame 110 so as to be slid back and forth by means of a rod guide 216 mounted upon the frame 110. The positioning members 214 are positioned upon opposite sides of the binding station 144 and are mounted upon the rods 212 in such an orientation that steel wire receiving portions **214*a* of the positioning members 214 are aligned with each other and the binding station 144**.

The rear ends of the rods 212 are interconnected by means of a connecting piece 220 of an aligning mechanism 218 for aligning the steel wire inlet of the slot 178 with the steel wire outlet of the steel wire feeding path 202 during the stoppage of the twisting mechanism 172. The aligning mechanism 218, as shown in FIG. 11, comprises a spring 222 disposed upon the end of each rod 212 so as to bias each rod 212 forwardly, and a dog clutch 224 in addition to the connecting piece 220.

The dog clutch 224 is provided with a first end **224*a* fixed to the rear end of the rotary shaft 174 and a second end 224*b* fixed to connecting piece 220 so as to be disposed opposite the first end portion 224*a*. The dog clutch 224 is a so-called torsional clutch having two saw-tooth-like teeth with inclined surfaces upon the respective ends thereof 224*a*, 224*b*** which are provided with the teeth opposed to each other.

The dog clutches 224 are normally coupled with each other when the rods 212 are normally biased forwardly by means of springs 222. However, the dog clutches 224 can be disengaged from each other by holding the reinforcement binding machine 100 with one's hands so as to apply the positioning member 214 onto the reinforcements 102,104 to be bound while moving the reinforcement binding machine 100 against the reinforcements 102, 104 so as to retract each rod 212 against the force of its spring 222.

Figure 12:
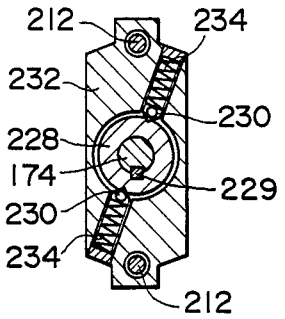
FIG. 12 is a sectional view taken along the line 12—12 in FIG. 6.

Furthermore, as shown in FIGS. 6 and 12, the reinforcement binding machine 100 has an orientation maintaining mechanism 226 for maintaining the orientation of the twisting mechanism 172 at an orientation wherein the steel wire inlet of the slot 178 is aligned with the steel wire outlet of the steel wire feeding path 202, even if the dog clutch 224 is disengaged in the stationary state of the twisting mechanism 172. The orientation maintaining mechanism 226 is a low torque slip mechanism provided with a disk 228 fixed to the rear end of the rotary shaft 174 and stoppers 230 disposed so as to be capable of being in or out of V-shaped notches formed at two symmetric positions upon the outer periphery of the disk. Each stopper 230 in the embodiment shown is a ball disposed within a hole provided within a plate 232 which is fixed to the rear wall of the frame 110, each stopper 230 being pressed toward the disk 228 by means of a spring 234 disposed within the hole of the plate 232.

The disk 228 is fixed to the rotary shaft 174 by means of a key 229 so as to receive each stopper 230 within its notch when the twisting mechanism 172 has an orientation in which the steel wire is received within the slot 178, that is, when the slot 178 is aligned with the steel wire outlet of the steel wire feeding path 202. When each stopper 230 is pushed into the notch of the disk 228, the teeth of the dog clutch 224 mesh with each other.

Upon the cover 116 are mounted the rotary source 120, clutches 128, 142, and a switch 236 for controlling the brake 130. The switch 236 is mounted at a position opposed to the dog clutch 224. The switch 236 is activated when the positioning members 214 are moved toward the reinforcements 102, 104 to be bound as a result of the binding machine 100 being moved toward the reinforcements 102, 104 so as to retract each rod 212, and is closed by means of the dog clutch 224 when the reinforcements 102, 104 reach predetermined positions with respect to the binding station 144.

Figure 13:
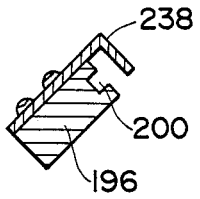
FIG. 13 is a sectional view taken along the line 13—13 in FIG. 4.

As shown in FIGS. 4 and 13, the guide 196 is provided with an auxiliary guide 238 for preventing the steel wire, fed through the slot 178 of the twisting mechanism 172 into the guide 196, from escaping from the steel wire guiding path 200. As shown in FIG. 13, the auxiliary guide 238 has an orientation in which the steel wire guide path 200 opens in front of the rotational direction of the steel wire rotated by means of the twisting mechanism 172 within the steel wire guide paths 200, 198 when the steel wire is twisted. Thus, when the steel wire within the steel wire guide path 200 is rotated about the rotary axis of the twisting mechanism 172 and therewith, the steel wire ordinarily tends to escape from the steel wire guide path 200. The auxiliary guide 238 in the embodiment shown is provided within the steel wire inlet of the guide 196, however, it may be provided throughout the inside of the guide 196.

During stand-by, the dog clutch 224 is engaged since each rod 212 is pushed forwardly by means of the spring 222. Thus, a force acts upon the end 224*a* of the dog clutch 224 for turning the rotary shaft 174 in the direction opposite to the rotational direction of twisting through means of the end 224*b*.

However, since each stopper 230 of the orientation maintaining mechanism 226 engages the recess of the disk 228, the twisting mechanism 172 is maintained at the orientation in which the slot 178 is aligned with the steel wire outlet of the steel wire feeding path 202. Thus, when binding the reinforcements, the slot 178 does not need to be aligned with the steel wire outlet of the steel wire feeding path 202 and the steel wire inlet of the steel wire guide path 200 of the guide 196.

At the time of binding, the reinforcement binding machine 100 causes the ends of guides 194, 196 and the positioning members 214 to coincide with the direction of the reinforcement 102 and is biased against the reinforcements 102, 104 within an orientation in which the surface defining the V-shaped space 208 between the guides 194, 196 is applied to the reinforcements 102, 104. Thus, since the force for separating the end of the guide 196 from the end of the guide 194 acts upon the end of the guide 196, the guide 196, as shown in FIG. 14, is adapted to expand the space between the respective ends of the guides 194, 196 by means of the reinforcements 102, 104 acting against the spring 206 while being angularly rotated so as to receive the reinforcements 102, 104 within the binding station 144.

The reinforcements 102, 104 entering the binding station 144 are received by means of the positioning members 214. Thus, since the position of the reinforcements 102, 104 within the binding station 144 is determined, the operation for relatively positioning the reinforcements 102, 104 and the reinforcement binding machine 100 is not needed. When the reinforcements 102, 104 are received within the binding station 144, the guide 196 is returned to its original position by means of the spring 206.

When the reinforcement binding machine 100 is pushed further, each positioning member 214 is pushed by means of the reinforcements 102, 104 so that each rod 212 is retracted against the force of its spring 222. When the reinforcements 102, 104 reach a predetermined position within the binding station 144, the switch 236 is closed by means of the dog clutch 224. Therefore, since the rotary source 120 and the clutch 128 are operated first, the steel wire 106 is fed through the steel wire feeding path 202 to the binding station 144 by means of the steel wire feeding mechanism 146. At this time, the dog clutch 224 is disengaged, while the twisting mechanism 172 is maintained by means of the orientation maintaining mechanism 226 at the orientation in which the slot 178 is aligned with the steel wire outlet of the steel wire feeding path 202.

The end of the steel wire fed to the binding station 144 reaches the steel wire guide path 200 of the guide 196 through means of an inner portion which has a depth greater than that of the pins 184 disposed within the slot 178. When the steel wire 106 is fed out further, the end of the steel wire advances while contacting the bottom surface of the steel wire guide path 200. The other fed portion of the steel wire, however, tends to escape from the steel wire guide path 200 due to the rigidity of the steel wire itself.

However, since the auxiliary guide 238 is provided within the steel wire inlet of the guide 196, the fed-out steel wire does not escape from the steel wire guide path 200 and is bent by means of the auxiliary guide 238 along the steel wire guide path 200. Thus, the end of the fed steel wire advances along the steel wire guide paths 200, 198, again reaches the steel wire guide path 200 of the guide 196 through means of the inner portion having a depth greater than that of the pins 184 disposed within the slot 178 and is wound around the reinforcements 102, 104 in the form of a loop defined by means of a plurality of turns, for example, two to five turns. Thus, each pin 184 is located inside the loop formed from the fed steel wire.

When the steel wire 106 is fed by a predetermined amount, the clutch 128 is disengaged, the brake 130 is operated, and the feeding of the steel wire 106 is stopped. Instead, the clutch 142 is operated so as to rotate the twisting mechanism 172. Therefore, the steel wire fed to the binding station 144 and wound around the reinforcements 102, 104 is cut off by means of the cooperation of the steel wire receiving portion of the head 176 and the steel wire outlet of the steel wire feeding path 202 of the guide 194 at the time of beginning the rotation of the rotary shaft 174 and the head 176, the same being twisted by means of the rotation of the pins 184. In this way, since the steel wire receiving portion of the head 176 and the steel wire outlet of the steel wire feeding path 202 of the guide 194 are constructed so as to cut off the steel wire, a cutter for cutting the wire and a mechanism for driving the cutter are dispensed with. As a result, the construction of the machine is simplified and economized.

Since the steel wire is twisted while contacting the end 184*a* of each pin 184, the pins 184 are subjected to a force which tends to separate the pins 184 from each other by means of a reaction to the twisting operation. Thus, the steel wire is twisted to a predetermined degree. When the force exceeds the force of the spring 190, the twisted steel wire escapes from between the pins 184. Therefore, the steel wire can be twisted to a predetermined degree at all times. The torsional strength of the steel wire may be set to any desired value by adjusting the position of the nut 192 upon the rotary shaft 174 and the receiving seat 186 so as to adjust the force of the spring 190.

Thereafter, when the reinforcement binding machine 100 is retracted, since each rod 212 and the dog clutch 224 are advanced by means of its spring 222, the switch 236 is opened so as to stop the rotary source 120 and release the clutch 142. The bound reinforcements 102, 104 can be removed from the binding station 144 by further retraction of the reinforcement binding machine 100 so as to expand the space between the ends of the guides 194, 196 by means of the reinforcements 102, 104.

When the dog clutch 224 is again engaged, a force due to the force of each spring 222 as applied to the contact surfaces of the ends 224*a*, 224*b* acts upon the rotary shaft 174 in the direction opposite to the rotational direction of twisting. As a result, the rotary shaft 174 is rotated until each stopper 230 of the orientation maintaining mechanism 226 engages its recess within the disk 228. The twisting mechanism 172 is maintained at the orientation in which the slot 178 is aligned with the steel wire outlet of the steel wire feeding path 202.

Figure 16:
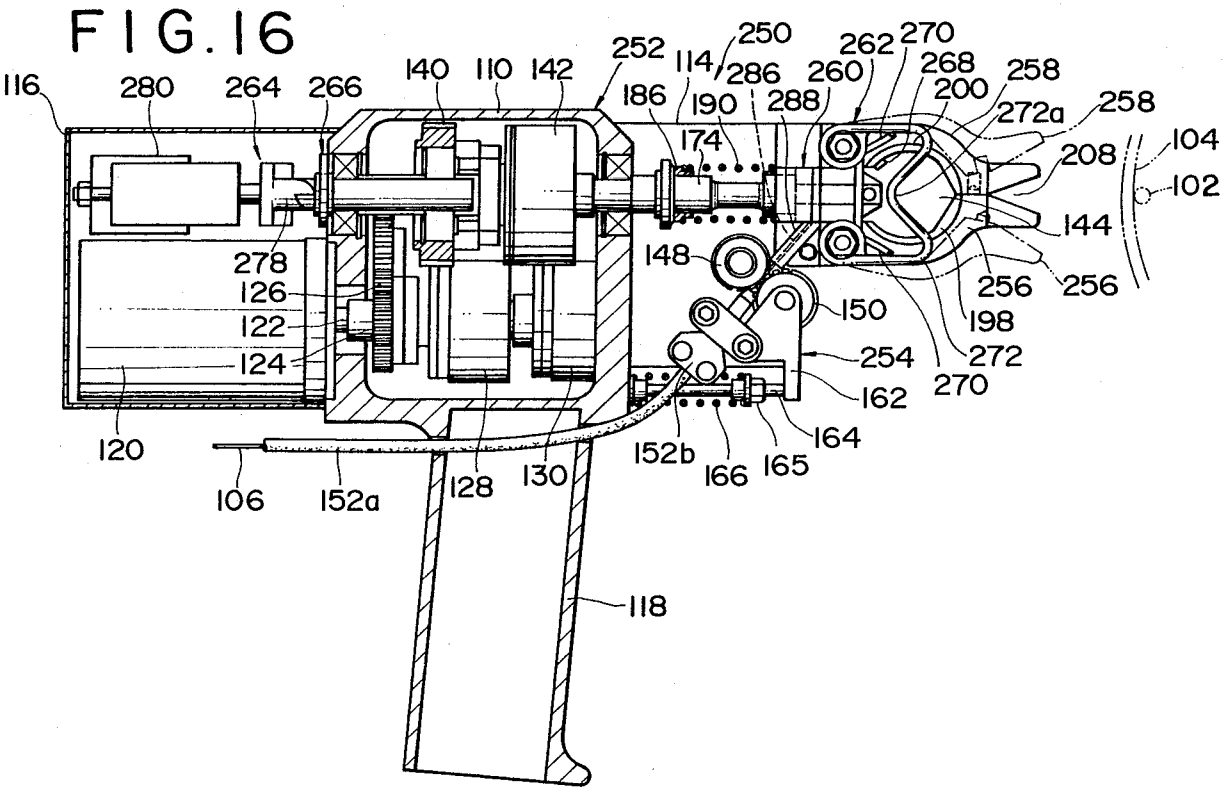
FIG. 16 is a longitudinal sectional view showing a further embodiment of the reinforcement binding machine according to the present invention.
Figure 17:
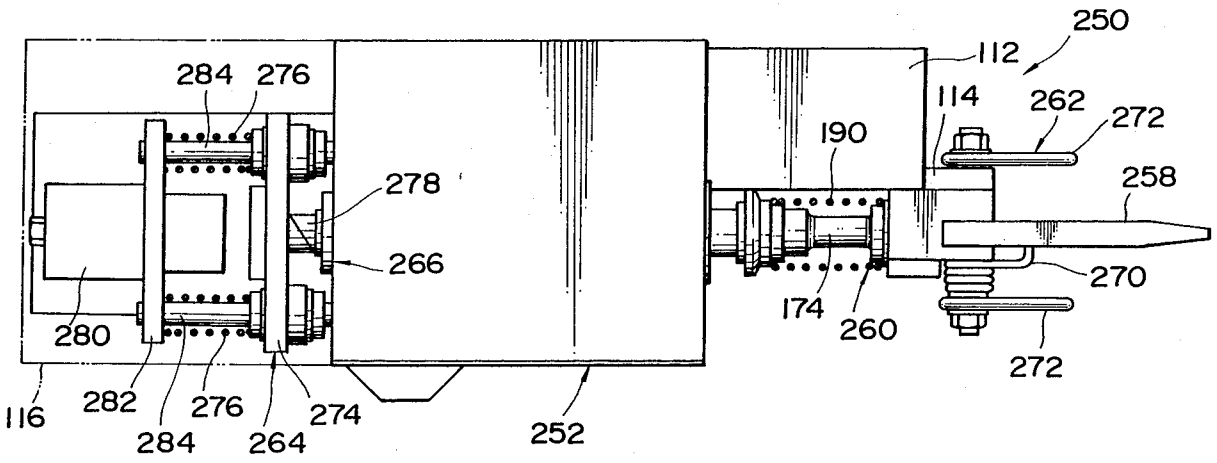
FIG. 17 is a plan view showing the binding machine shown in FIG. 16.

Next, there will be described a reinforcement binding machine 250 shown in FIGS. 16 and 17. Furthermore, the same members as those of the reinforcement binding machine 100 shown in FIGS. 1 to 14 will be designated by the same symbols and the description of the operation of such common subject matter will be omitted.

The reinforcement binding machine 250 also comprises a main body 252 having a handle portion 118, a steel wire feeding mechanism 254, a pair of guides 256, 258 for defining the binding station 144, a twisting mechanism 260 for twisting the steel wire fed into the binding station 144, a rotary mechanism including the rotary source 120 for rotating the steel wire feeding mechanism 254 and the twisting mechanism 260, a positioning mechanism 262 for positioning the reinforcements 102, 104 within the binding station 144, an aligning mechanism 264 for the twisting mechanism 260, and an auxiliary guide 268 provided on an orientation maintaining mechanism 266 and the guide 258.

The main body 252, twisting mechanism 260, rotary mechanism, orientation maintaining mechanism 266, and auxiliary guide 268 are constituted from the same members as those of the corresponding mechanism of the reinforcement binding machine 100 and are operated in the same way as such mechanisms.

The steel wire feeding mechanism 254 is constituted from the same members as the steel wire feeding mechanism 146 of the reinforcement binding machine 100 and is operated in the same way as the mechanism 146, although it is arranged relatively upside-down, compared with the steel wire feeding mechanism 146 of the reinforcement binding machine 100 so as to feed the steel wire 106 in an inclined manner from a lower position to an upper position.

A pair of guides 256, 258 are supported by means of the support wall 114 so as to be rotated angularly for moving the ends toward and away from each other and the ends are biased by means of springs 270 so as to contact each other.

The positioning mechanism 262 is provided with a pair of M-shaped bent positioning members 272 which are fixed to the support wall 114 by means of bolts and nuts in such an orientation that V-shaped reinforcement receiving portions 272*a* are aligned with each other and the binding station 144.

The aligning mechanism 264 is provided with a connecting piece 274, a pair of springs 276, a dog clutch 278, and a solenoid mechanism 280 for disengaging the dog clutch against the force of the springs 276. Each spring 276 is arranged around a shaft 284 which is fixed to the connecting piece 274 and a plate 282 which is disposed parallel to the connecting piece 274. The solenoid 280 is fixed to the plate 282.

The steel wire feeding path 286 for guiding the steel wire 106 fed from the steel wire feeding mechanism 254 to the binding station 144 is formed into a feed guide 288 which is fixed to the support wall 114. The end face of the feed guide 288 at the side of the binding station 144 is curved so as to have the same radius of curvature as the head of the twisting mechanism 260 in order to closely contact the head and cut off the steel wire.

In the reinforcement binding machine 250, the dog clutch 278 is biased forwardly and engaged by means of the springs 276 in a stand-by mode. Since the stopper of the orientation maintaining mechanism 266 engages the recess of the disk, the twisting mechanism 260 is maintained at the orientation at which the slot of the twisting mechanism 260 is aligned with the steel wire outlet of the steel wire feeding path 286.

At the time of binding, the reinforcement binding machine 250 disposes the ends of the guides 256, 258 and the positioning members 272 at orientations which coincide with the direction of the reinforcement 102 and is biased toward the reinforcements 102, 104 at an orientation at which the surfaces of the guides 256, 258 defining the V-shaped space 208 are applied to the reinforcements 102, 104. Thus, the guides 256, 258 are angularly rotated in the direction of separating the ends from each other so as to receive the reinforcements 102, 104 within the binding station 144.

Under such a condition, a switch (not shown) is manually closed, the rotary source 120 and clutch 128 are operated, and the steel wire 106 is fed through the steel wire feeding path 286 to the binding station 144 by means of the steel wire feeding mechanism 254. The steel wire fed to the binding station 144 reaches the steel wire guide path 200 of the guide 258 through means of the inner portion having a depth greater than that of pins 184 disposed within the slot 178 of the twisting mechanism 260. When the steel wire 106 is fed out further, the fed steel wire is bent along the steel wire guide path 200 by means of the auxiliary guide 268 while advancing along the steel wire guide paths 200, 198, and is wound around the reinforcements 102, 104 in the form of a loop defined by means of a predetermined number of turns after again passing through the passage from the inner portion having a depth greater than that of pins 184 disposed within the slot of the twisting mechanism 260 to the steel wire guide path 200 of the guide 258. Thus, each pin 184 is located inside the loop formed by means of the fed steel wire.

When a predetermined amount of the steel wire 106 has been fed out, the clutch 128 is disengaged, and the brake 130 is operated so as to stop the feeding of the steel wire 106. Then, the dog clutch 278 is first disengaged by energizing the solenoid 280 and then the twisting mechanism 260 is rotated by operating the clutch 142. In this case, the steel wire wound around the reinforcements 102, 104 is cut off by means of the steel wire inlet of the head of the twisting mechanism 260 and the steel wire outlet of the steel wire feeding path 286 of the feeding guide 288 at the time of beginning the rotation of the head and the rotary shaft of the twisting mechanism 260, the same thereby being twisted by means of the rotation of the pins 184.

When the steel wire is twisted, it is twisted while contacting the end of each pin 184 and the force of separating the pins 184 from each other acts upon each pin 184 through means of a reaction to the twisting operation. Therefore, when the steel wire is twisted to a predetermined degree and the force exceeds the force of the spring 190, the twisted steel wire escapes from between the pins 184. Hence, the switch is manually opened, the rotary source 120 is stopped, the solenoid 280 is deenergized, and the dog clutch is again engaged.

When the dog clutch 278 is again engaged, since the force in the direction opposite to the rotational direction of twisting acts upon the rotary shaft 174, of the twisting mechanism 260, the rotary shaft 174 is rotated until each stopper of the orientation maintaining mechanism 266 engages its recess defined within the disk, and the twisting mechanism 260 is maintained at the orientation at which each recess is aligned with the steel wire outlet of the steel wire feeding path 286.

Thereafter, the reinforcement binding machine 250 is retracted from the reinforcements 102, 104 and can be removed relative to the binding station 144 by expanding the space defined between the ends of the guides 256, 258 relative to the reinforcements 102, 104.

Obviously, many modifications and variations of the present invention are possible in light of the above teachings. It is therefore to be understood that within the scope of the appended claims, the present invention may be practiced otherwise than as specifically described herein.

What is claimed is:

1. A reinforcement binding machine using a steel wire comprising:

a means for feeding said steel wire into a binding station for binding reinforcements;

a guide means provided with a guide path for guiding said steel wire fed into said binding station along a curve encircling said reinforcements, and defining said binding station;

a means for twisting said steel wire looped by said guide path and defining a slot, through which said steel wire fed in said binding station is capable of passing; and a means for rotating said twisting means about the axis crossing the axis of the loop formed of said steel wire such as to twist said steel wire;

said twisting means being provided with a pair of pins opposed to each other through said slot to be moved relatively in the axial direction of said loop and a means for normally urging at least one of said pins such that the end faces of the pins are butted against each other in said binding station.

2. A reinforcement binding machine as claimed in claim 1, wherein said twisting means is further provided with a rotor having said slot and said pins are supported at a portion opposed to each other through said slot of said rotor to move toward and away from each other.

3. A reinforcement binding machine as claimed in claim 2, wherein said rotor is provided with a rotary shaft extending in a direction orthogonal to the moving direction of said pin and a head provided fixedly to the end of the rotary shaft at the side of said binding station and defining said slot.

4. A reinforcement binding machine as claimed in claim 3, wherein said urging means comprises a receiving ring fixed to said rotary shaft, a slider supported around said rotary shaft movable in the direction of the rotary axis of the rotary shaft and having an end contacting said pins to move said pins toward each other and a spring disposed between said slider and said receiving ring and urging said slider in the direction along said rotary axis to move said pins toward each other.

5. A reinforcement binding machine as claimed in claims 3, wherein said urging means is provided with a pair of leaf springs supported by said rotary shaft and contacting the opposite side end face to the opposed end faces of said pins to urge said pins to move toward each other.

6. A reinforcement binding machine as claimed in claim 1, wherein the end face of at least one of said pins butted against that of said other pin has a shape so as to produce a force for separating said both pins from each other during twisting of said steel wire.

7. A reinforcement binding machine as claimed in claim 1, wherein it further comprises a main body having a handle portion and supporting said feeding means, said guide means, said twisting means and said rotating means, and the end face of at least one of said pins butting against said other pin having a shape so as to produce a force for separating both said pins from each other during twisting of said steel wire.

8. A reinforcement binding machine as claimed in claim 7, wherein it further comprises a means for positioning said reinforcements in said binding station.

9. A reinforcement binding machine as claimed in claim 8, wherein said positioning means is provided with a pair of Y-shaped or M-shaped members disposed symmetrically about said binding station.

10. A reinforcement binding machine as set forth in claim 1, further comprising:

said feeding means is provided with a member for defining a wire feeding path extending toward said binding station; and a portion of said twisting means for defining said slot, through which said steel wire is received in said slot, contacts closely a wire outlet of said member for defining said wire feeding path so as to provide a cutter portion for cutting off said steel wire in cooperation with said wire outlet during rotation of said twisting means.

11. A reinforcement binding machine as set forth in claim 1, further comprising:

said feeding means is provided with a member for defining a wire feeding path extending toward said binding station; and a means for aligning said slot with a wire outlet of said member for defining said wire feeding path so as to receive said steel wire in said slot by angularly rotating said twisting mean to a relatively non-rotational position of said twisting means.

12. A reinforcement binding machine as claimed in claim 11, wherein said aligning means is provided with a movable body slidable in the direction of the rotary axis of said twisting means, a dog clutch having a first tooth and a second tooth, the axis of the dog clutch coinciding with the rotary axis of said twisting means, said first tooth being fixed to said twisting means, said second tooth being fixed to said movable body, a spring for urging said dog clutch and said movable body in the direction of coupling the dog clutch, and a positioning member fixed to said movable body and pressed against at least one of said reinforcements when binding said reinforcements so as to move said movable body in the direction of disengaging said dog clutch.

13. A reinforcement binding machine as claimed in claim 11, wherein said aligning means is provided with a movable body slidable in the direction of the rotary axis of said twisting means, a dog clutch having a first tooth and a second tooth, the axis of the dog clutch coinciding with the rotary axis of said twisting means, said first tooth being fixed to said twisting means, said second tooth being fixed to said movable body, and a solenoid mechanism for coupling and disengaging said dog clutch.

14. A reinforcement binding machine as claimed in claim 11, wherein it further comprises a means for maintaining said twisting means at an orientation in which said slot is aligned with said wire outlet in a relatively non-rotational state of said twisting means.

15. A reinforcement binding machine as claimed in claim 14, wherein said orientation maintaining means is provided with a disk fixed to said twisting means coaxially with the rotary axis of the twisting means and having a recess on an outer peripheral edge, a stopper disposed in said recess so as to be partially in and out of the recess and a spring for urging the stopper toward said recess.

16. A reinforcement binding machine as set forth in claim 1, further comprising:

said feeding means is provided with a member for defining a wire feeding path extending toward said binding station; and said guide means being provided with a pair of first guides each having an arcuate shape and said guide path along said arcuate guides at a side of said slot to guide said steel wire fed into said binding station along said curve and disposed relatively movable so as to move the opposed guides toward and away from each other with reference to the rotary axis of said twisting means and a second guide disposed in the neighborhood of a portion of said first guide for receiving said steel wire from at least said wire feeding path end and for preventing said steel wire fed along said guide path from escaping from said guide path.

17. A reinforcement binding machine as claimed in claim 16, wherein said guide path opens to said arcuate side of said first guide.

18. A reinforcement binding machine as claimed in claim 16, wherein said second guide is provided fixedly in the proximity of the wire inlet of said first guide.

19. A reinforcement binding machine as claimed in claim 16, wherein said second guide is disposed so as to be capable of approaching or retreating from the proximity of the wire inlet of said first guide.

20. A reinforcement binding machine with a steel wire comprising:

a means for feeding said steel wire along a wire feeding path extending toward a binding station for binding reinforcements;

a guide means provided with a guide path for guiding said steel wire fed into said binding station along a curve encircling said reinforcements and defining said binding station;

a means for twisting said steel wire looped by said guide means and defining a slot, through which said steel wire fed into said binding station is capable of passing;

a means for rotating said twisting means about the axis crossing the axis of the loop formed of said steel wire to twist said steel wire; and a means for aligning said slot with a wire outlet of a member for defining said wire feeding path such as to receive said steel wire in said slot by rotating angularly said twisting means to a relatively non-rotational position of said twisting means;

said twisting means being provided with a pair of pins opposed to each other through said slot and disposed to move relatively in the axial direction of said loop and a means for normally urging at least one of said pins such that the end faces of the pins are butted against each other in said binding station;

a portion of said twisting means for defining a portion of said slot to receive said steel wire contacting closely a wire outlet of a member for defining said wire feeding path so as to provide a cutter portion for cutting off said steel wire in cooperation with said wire outlet during rotation of said twisting means;

said guide means provided with a pair of first guides having an arcuate shape and said guide path along said arcuate guides at said arcuate side such as to guide said steel wire fed into said binding station along said curve and disposed relatively movable so as to move the opposed guides toward and away from each other with reference to the rotary axis of said twisting means and a second guide disposed in the neighborhood of a portion of said first guide for receiving said steel wire from at least said wire feeding path of said first guide and for preventing said steel wire fed into said guide path from escaping from said guide path.

* * * * *